US005118115A

United States Patent [19]

Codinha

[11] Patent Number: 5,118,115

[45] Date of Patent: Jun. 2, 1992

[54] ECONOMIC AND MILITARY CONFLICT BOARD GAME

[76] Inventor: J. Albert Codinha, 3520 Lebon Dr., #5321, San Diego, Calif. 92122

[21] Appl. No.: 347,289

[22] Filed: May 4, 1989

[51] Int. Cl.[5] ..... A63F 3/00

[52] U.S. Cl. ..... 273/255; 273/256

[58] Field of Search ..... 273/255, 256, 257, 262, 273/251, 252, 254

[56] References Cited

U.S. PATENT DOCUMENTS

| | | | |
|---|---|---|---|
| 2,273,292 | 2/1942 | Smith | 273/255 |
| 3,467,387 | 9/1969 | Schmitt | 273/256 |
| 3,756,604 | 9/1973 | Laszlo | 273/256 |
| 3,944,229 | 3/1976 | Feeney | 273/245 |
| 4,239,229 | 12/1980 | Crossley | 273/255 |
| 4,283,059 | 8/1981 | Beeder | 273/254 |
| 4,441,718 | 4/1984 | Olson | 273/254 |
| 4,480,837 | 11/1984 | Poirier | 273/252 |
| 4,572,514 | 2/1986 | Aponte | 273/255 |
| 4,736,954 | 4/1988 | Haney et al. | 273/236 |
| 4,765,627 | 8/1988 | Ross | 273/255 |

FOREIGN PATENT DOCUMENTS

| | | | |
|---|---|---|---|
| 2139510 | 11/1984 | United Kingdom | 273/256 |

*Primary Examiner*—Benjamin Layno

*Attorney, Agent, or Firm*—Brown, Martin, Haller & McClain

[57] ABSTRACT

A competitive board game representing world alliances competing economically and militarily for world power, wherein a game board is provided imprinted with a map of the world or a substantial portion thereof, which map is divided into a cellular network for placement of playing pieces, and bordered by a path consisting of a plurality of spaces representing the countries of the map interspersed with spaces of chance, for movement of playing tokens as indicated by chance means, whereby the players, through a combination of luck and skill, employ economic and/or military strategies to dominate the world.

14 Claims, 4 Drawing Sheets

ECONOMIC AND MILITARY CONFLICT BOARD GAME

FIELD OF THE INVENTION

The present invention relates to a game playable on a board and more particularly to a board game utilizing economic data in coordination with military tactics and luck to play. The invention further relates to a board game in which military maneuvers of armies and navies are partially controlled or affected by economic values associated with countries on a world map.

BACKGROUND OF THE RELATED ART

It has long been known that a variety of games are possible using the format of economic trade related to real estate and property purchase and rentals. There are several proprietary games such as MONOPOLY TM and EASY MONEY TM which are based on this approach.

In these types of games, several players move playing pieces along a path delineated by subdivisions such as squares which are assigned predetermined economic values. Players buy, sell, trade and rent properties on these subdivisions based on the economic values. Through the use of limited planning and luck, one player eventually achieves economic domination over the other players and thus wins the game.

A widely used second format for games is the varietal war game format. In this approach, a game board is subdivided into countries, which may duplicate the world as known, or battlefields on which armies are used to wage war. Such games may also involve navies. While there are a variety of rules available for determining the number of armies and navies and allowed moves, these games share the common feature that luck, throw of dice, and brute force generally produce the winning player. While certain levels of skill and tactics are useful in the above games, they have several limitations along this line. One limitation is that they rely heavily on the limited layout of the board as opposed to skill. That is, when a player lands on preassigned areas, that player automatically achieves an advantage over other players that is unrelated to skill and that almost no amount of skill can overcome. Secondly, the board layout and rules fail to account for more realistic limitations for economics and war such as overextension, modern weaponry, etc.

It would therefore be advantageous to provide a board game which provides greater flexibility in tactics based on both military and economic considerations. It would also be advantageous to provide a board game in which available military maneuvers are restricted to coincide with more realistic physical and economic limitations.

SUMMARY OF THE INVENTION

The present invention achieves these advantages while providing an entertaining, engrossing and stimulating game. The board game of this invention uses a planar playing surface which is subdivided into a series of countries in map form. This map is also subdivided into an overlaid network of cells, represented conveniently by hexagons. Bordering the map on the periphery is a plurality of geometrical spaces comprising colored markers representing each country on the map together with each country's economic value. Interspersed among these spaces are other spaces comprising markers of chance or luck.

The novel features of the present invention may be better understood from the following description taken in conjunction with the accompanying drawings, which set forth, by way of illustration and example, certain embodiments of this invention.

DESCRIPTION OF THE PREFERRED EMBODIMENTS

Figure 1:
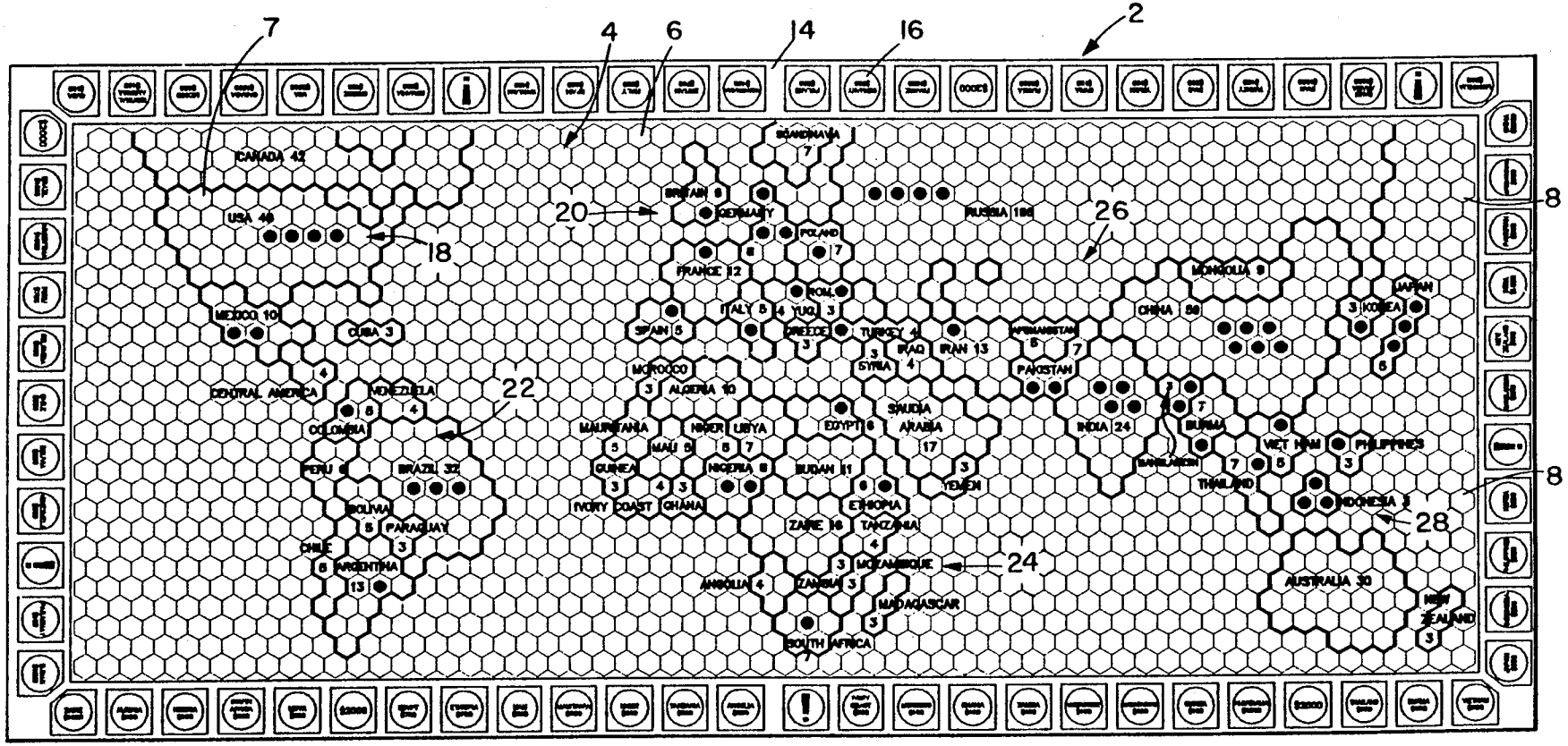
FIG. 1 shows the game board.
Figure 2A:
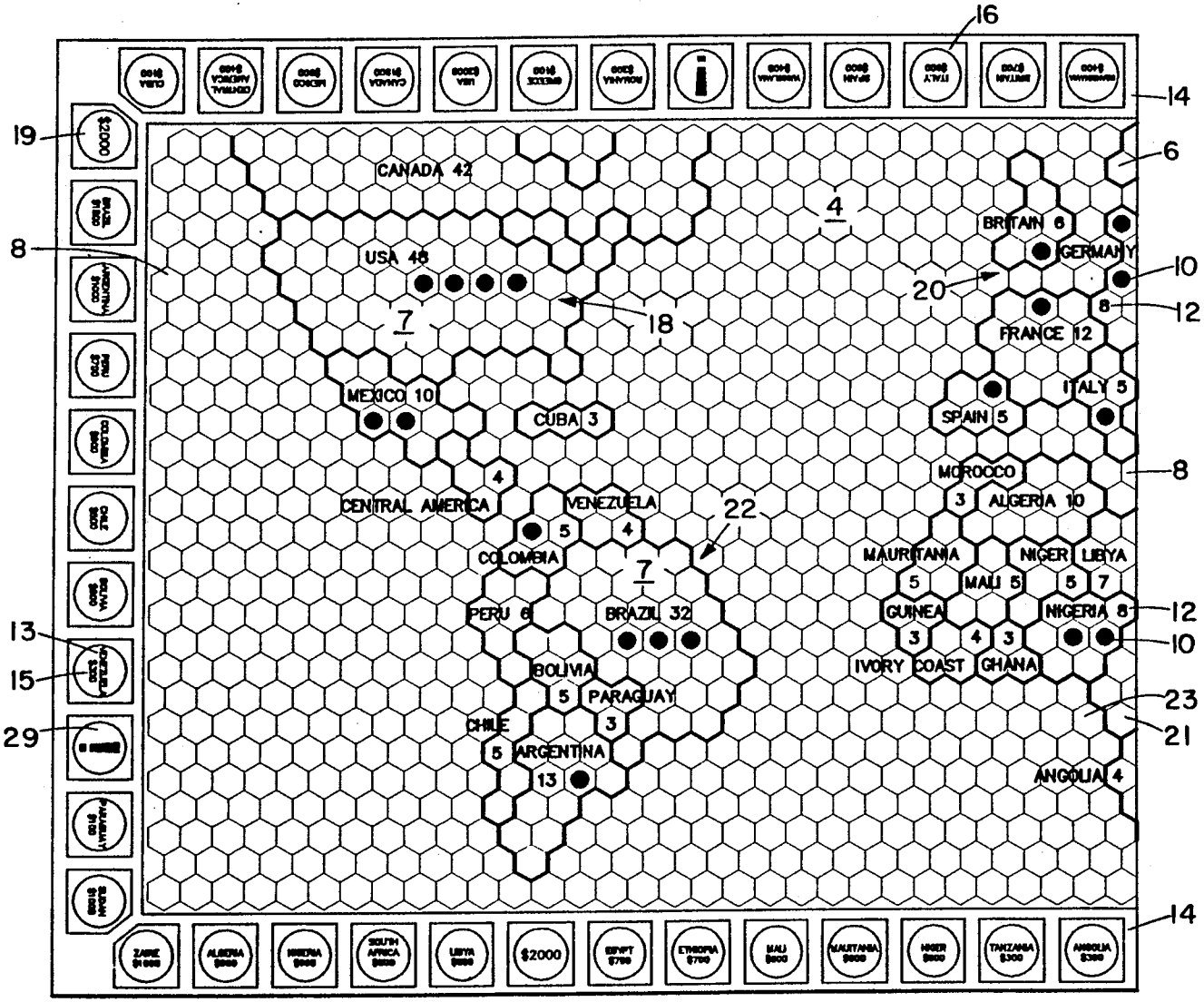
FIG. 2*a* shows one half of the game board.
Figure 2B:
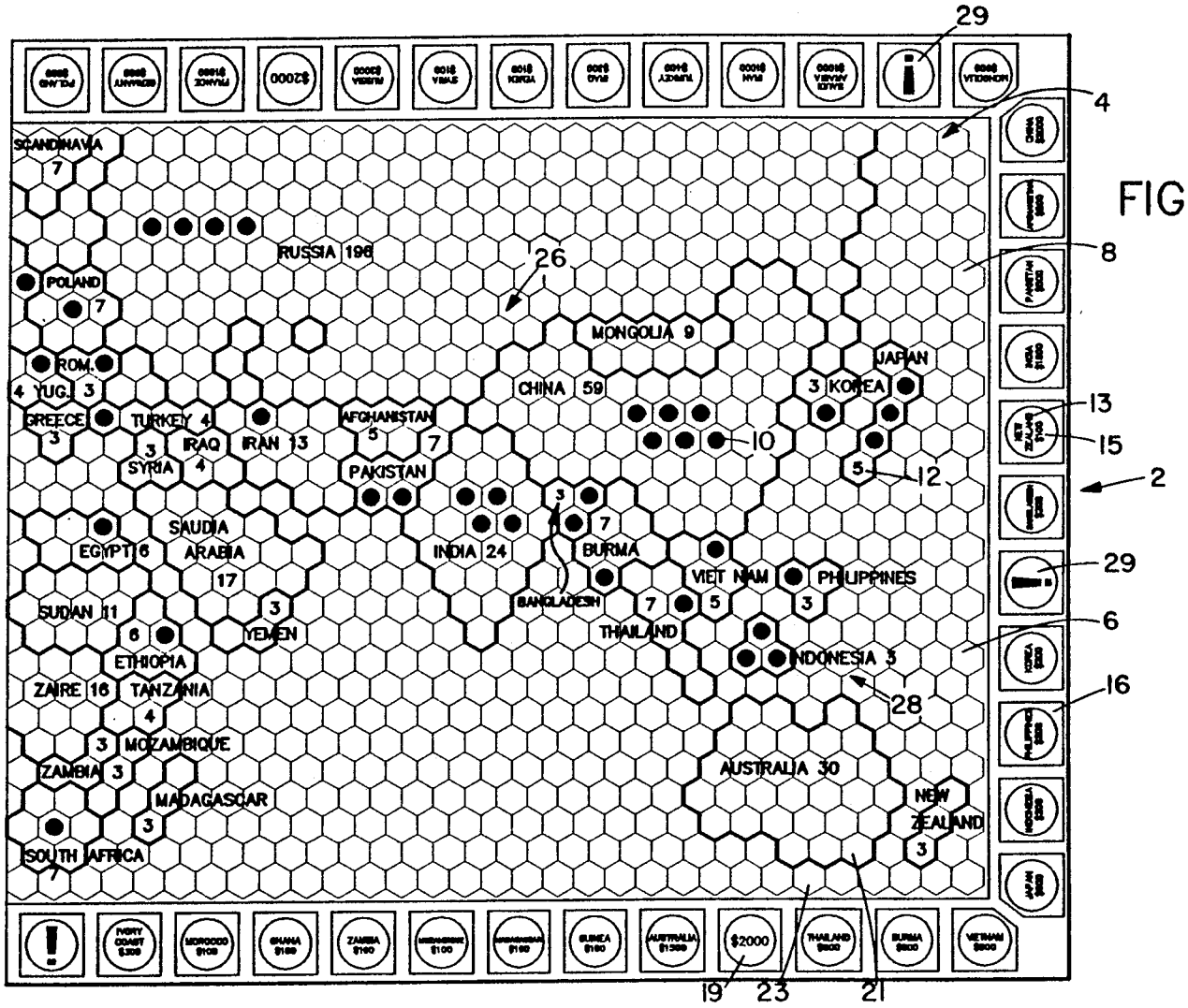
FIG. 2*b* shows the other half of the game board, in a larger scale than FIG. 1.
Figure 3:
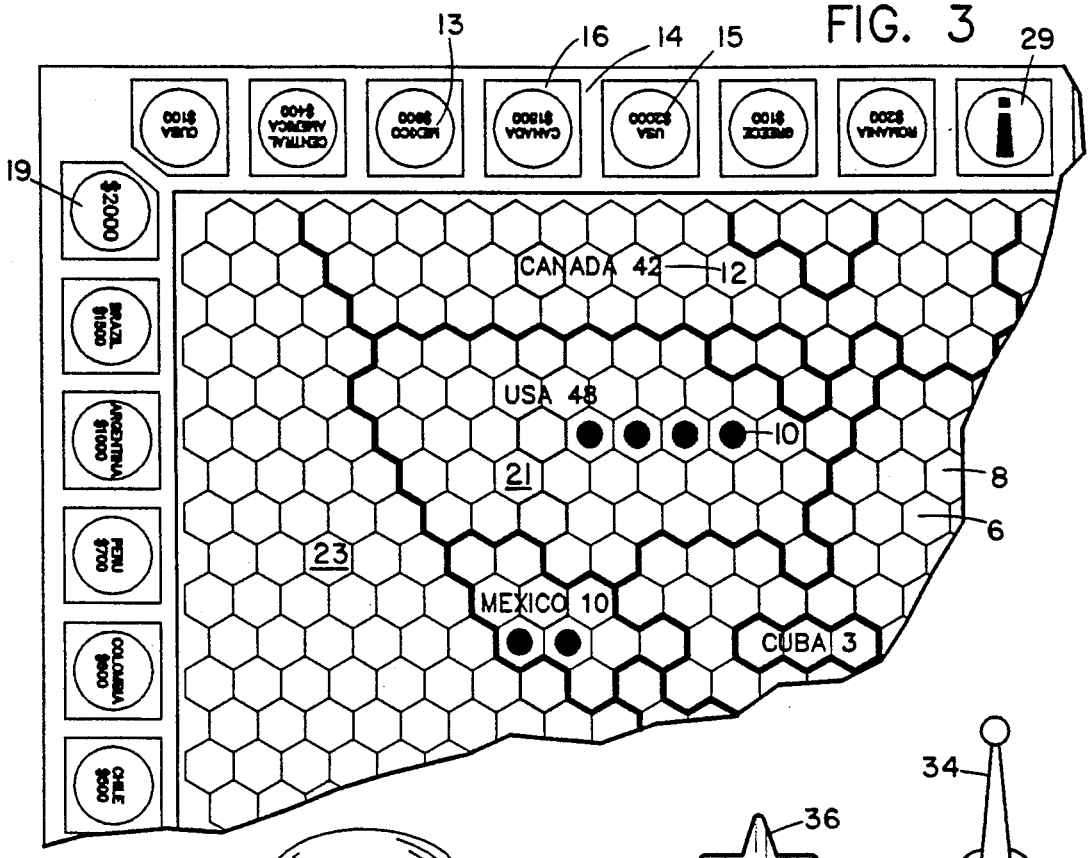
FIG. 3 shows the portion of the game board indicated by the dashed lines in FIG. 2*a*, enlarged to illustrate the detail.
Figure 4:
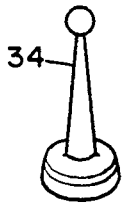
FIG. 4 is a perspective view of a first playing piece or token which is moved around the border of the game board by the player.
Figure 5:
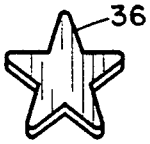
FIG. 5 is a perspective view of a second playing piece which represents an army, navy, or factory, respectively, depending on its placement on the game board.
Figure 7:
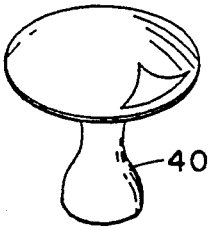
FIG. 7 is a perspective view of a fourth playing piece which represents nuclear "mushroom clouds."
Figure 6:
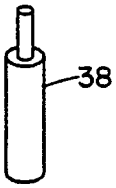
FIG. 6 is a perspective view of a third playing piece which represents a nuclear missile.
Figure 8:
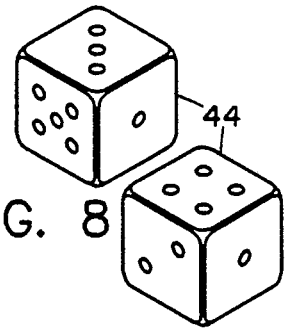
FIG. 8 is a perspective view of two of the dice used to determine the number of spaces the player may move around the game board.
Figure 9:
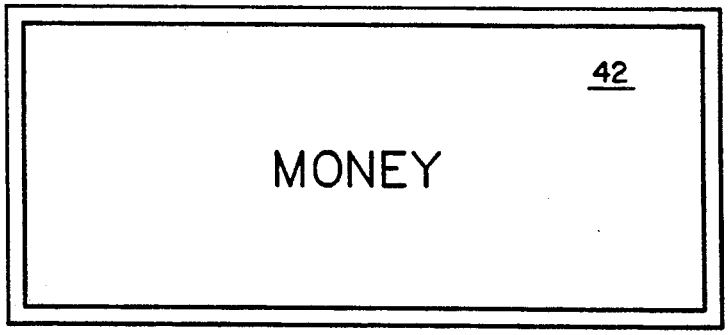
FIG. 9 shows the front of one denomination of simulated money.

Referring to FIG. 1, game board 2 includes a depiction of a map of the world, or a substantial portion thereof, generally indicated as 4, containing nations and regions (designated 7). The map is stylized and some nations are grouped into regions, with only the latter indicated. The exact border shapes of each nation or region is not central to the game. The regions are used in recognition that for the purposes of the game many smaller nations have economic and military strength only in regional combinations. A cell network 6 is superimposed over the map 4. (The cells are illustrated as being of the preferred hexagonal shape, but could be of any convenient grid-covering shape such as squares or rectangles.) This network is arranged in horizontal rows 8, which may be followed through countries and over oceans, and which "wrap around" the west/east Pacific Ocean map border. Each row is coded as for instance by alphabetic codes A through BB) to facilitate the players' movements across the Pacific Ocean part of the map. Several of the nations and region 7 in map 4 have symbols 10 (here illustrated as circles) inside them which represent "population centers." The number underneath each nation's or region's name, indicated generally as 12, indicates the size of that nation or region (in hexagons). (For brevity herein, the term "country" will often be used to designate both nations and regions, where the game rules apply equally to either.)

The game board has a borders 14 in the form of a path comprising a plurality of spaces. Each space represents a different country 7 of the world and contains the names of the countries 13, together with the economic value of each, 15. These country spaces of border 14 are indicated as 16. Each country 7 is color with a distinctive visual indicator which indicates the major alliance of that country. Most conveniently the indicator is a color. There are six major alliances (designated 18, 20, 22, 24, 26 and 28) on the game board and therefore six coding colors. Corresponding color codes are also depicted on the map 4. In the play of the game each player must target only the color group (alliance) designated by the color of his playing piece 34. There may be any number of alliances used, but normally the total number will be 4–8 to make the game realistic and most playable. I have found that the preferred number of alliances is 5–7, and most preferably 6 for optimum realism and playability, Interspersed among the country spaces 16 of border 14 are a plurality of spaces 19 containing the symbol "!" (indicated as 30) or the amount "$2000" (indicated as 32), the purpose of which will be described hereinafter.

The apparatus of the game includes a number of first playing pieces or tokens 34, for movement about the border 14 of board 2 in a manner to be described more fully hereinafter. Second playing pieces 36 (preferably in the shape of stars and sized so as to fit within individual hexagons) are provided in the six major alliance colors. These second pieces represent armies if placed on a country hexagon 21, navies if placed on a water hexagon 23, and factories if placed on a country space 16 of border 14. Third playing pieces representing nuclear missiles and fourth playing pieces representing nuclear "mushroom clouds," which indicate that a country has been destroyed, are represented as 38 and 40, respectively. Simulated money 42 is provided as the medium of exchange. Four dice 44 are provided as a means of chance, to determine how many spaces the player may move.

The objective of the game is to become the dominant world power. This is accomplished when a player owns all of the countries 7 (which have not been destroyed by nuclear missiles) belonging to his targeted color group or major alliance 18, 20, 22, 24, 26 or 28 or bankrupts all his opponents. A player may employ economic or military tactics or any combination thereof to achieve this objective.

In preparation to play the game, a player is selected to be banker. The "bank" is responsible for selling the players the various armies, navies, missiles and factories. The bank starts each player with $2000 billion ("megabucks"). Each player chooses a token 34 and places it on any space along the border 14. Each player rolls four dice 44. The player with the highest total becomes the first to move. He rolls again and his token is moved in a clockwise direction around the border 14, followed in turn by all remaining players, usually by seating position around the board or by dice total obtained on the initial throw. Tokens remain on the spaces occupied and continue from that point on the players' subsequent turns. Two or more tokens may rest on the same space at the same time.

When a token 34 lands on or passes a "$2000" space 19, the player immediately collects $2000 megabucks from the bank. When a token 34 lands on or passes a "!" space 19, the player immediately collects a free nuclear missile 38 from the bank. If a player cannot deploy this missile by the end of that turn, he must return it to the bank. To deploy the missile 38, the player's token 34 must land on a country space 16 representing one of his own countries 7 having a population center 10 without missiles and he places the missile inside the population center.

When a player's token 34 lands on one of his own country spaces 16, he immediately collects a monetary benefit from the bank, the amount of which is determined by the number of factories on that space 16. When a player's token 34 lands on an opponent's country space 16, the player must pay the owner a monetary tribute for each factory 36 in that country. When a token 34 lands on an unowned country space 16, the player has the right to purchase that country at the listed price 15, although he is not obligated to do so. If he does not buy, his turn is over. If he chooses to buy, the bank will issue one playing piece 36 to be employed inside the country 7 purchased to prove the player's ownership.

During his turn, a player can choose to buy armies, navies and/or factories 36 from the bank for countries 7 which he already owns. The player must buy at least three (in any combination) and may buy as many as the total number of population centers 10 in the countries 7 he owns. Navies 36 may be deployed into any unoccupied water hexagon 23 as long as that navy is not immediately next to an opponent's navy. Armies 36, navies 36 and nuclear missiles 38 may not be deployed in the same hexagon 6. Only one playing piece 36 per hexagon 6 is allowed. Players may never move navies 36. Armies 36 may be moved only as described hereinafter when advancing after combat. Nuclear missiles 38 are removed from the board when launched, as described more fully hereinafter.

Once a player has acquired armies 36, navies 36 and nuclear missiles 38, he may choose to execute attacks on other countries 7. The player must pay a fee to the bank for each attack. The number of attacks a player may make is therefore limited by his financial resources. It is also limited by the number of armies 36 owned; armies 36 of the attacking country 7 must outnumber those of the defending country 7 by at least two. The player must announce which country 7 he is attacking and which combination of countries 7 he is attacking from to allow the country attacked to defend itself. An unowned country 7 may always be attacked.

Navies 36 act as "ferryboats" that transport armies 36 from an attacking country 7 and "land them" on the beaches of the defending country 7. Navies 36 themselves do not count as armies 36 in the attack and they do not attack each other. They simply serve "as a bridge." A navy 36 must be within five hexagons of a country 7 to function as such a bridge. If the attacking country 7 is within five hexagons of the defending country 7, no navy is necessary; a direct attack may be executed.

To resolve combat, first, all armies 36 in the defending country 7 are removed from the board and returned to the bank. Second, an equal number of armies 36 from the attacking country 7 are removed. Third, any nuclear missiles 38 and factories 36 remaining in the defending countries 7 become the property of the victor.

After combat, a player must advance one of the armies 36 remaining in the attacking country 7 into the country 7 conquered. More than one army 36 may be advanced, providing at least one army remains in the attacking country 7.

When a nuclear attack is announced, each player may launch any or all nuclear missiles 38 he has on the board. If an attack is announced on a country 7 that is itself armed with nuclear missiles 38, the defender in that country may launch any or all missiles he has on the board. A missile 38 is launched by moving it to the targeted country. All remaining players, in any order, launch any, all or none of their missiles 38 in the same way. When all players are satisfied that they have launched all the missiles 38 they wish to the selected target countries, the missiles are deemed "in flight."

After all players have designated their targeted countries, the owner of each targeted country, in turn, will role a die. If a one, two, three or four is rolled, the incoming missile 38 is shot down. If a five or six is rolled, the incoming missile 38 gets through that country's anti-ballistic defenses and that country 7 is successfully destroyed. If an unowned country 7 is targeted, any player other than the attacker may roll the die in its defense.

Whenever a country 7 is successfully destroyed, all armies 36 and missiles 38 are removed from it. All factories 36 are removed from the country space 16. A nuclear "mushroom cloud" 40 is placed in that country 7 on the map. Players may not buy or attack this country again.

The game is won when a player owns all the countries 7 (which have not been destroyed by nuclear missiles) belonging to his targeted group or major alliance 18, 20, 22, 24, 26 or 28 or bankrupts all his opponents. From the foregoing, it is seen that a player has several options available to him throughout the game of an economic and/or military nature. His choice of options or his strategy, combined with luck, enables a player to win the game.

Although the present invention has been described in some detail for purposes of clarity and understanding, it is understood that certain changes and modifications not illustrated above may be made within the spirit of the invention. The scope of this invention is therefore to be limited solely by the appended claims.

What is claimed is:

1. A board game apparatus simulating international economic and military conflict, which comprises:

a playing board comprising a map illustrating at least a portion of each of the principal nations and geographical regions of the world, said illustrated nations or regions each containing indicia indicating the number of population centers therein, said number of population centers in each said nation of region corresponding to the number of second playing pieces purchasable, and said map being overlaid by a network of cells and being bordered by a path comprising a plurality of spaces each identifying one of said nations or regions or defining an instruction of chance;

a plurality of first playing pieces for individual movement along said path in the course of the game;

first chance means to determine the amount of movement of said first pieces along said path;

a plurality of second playing pieces representing military or naval forces or economic factors, each of said second playing pieces having a monetary value, and wherein the total number of said population centers in nations and regions owned by a player is the maximum number of said second playing pieces purchasable by said player;

a plurality of third playing pieces representing offensive and defensive weapons;

a plurality of fourth playing pieces representing nuclear annihilation; and simulated money;

each of said first pieces when moved along said path in response to the movements determined by said first chance means determining military and economic opportunities of the player represented by said piece with respect to the other players, said opportunities being symbolized by placement and/or utilization of said second, third and fourth pieces on said cells in simulated military actions or by economic transactions involving said simulated money.

2. The board game apparatus of claim 1 wherein said nations and geographical regions are divided into groups representing major alliances.

3. The board game apparatus of claim 2 wherein there are 4–8 groups.

4. The board game apparatus of claim 3 wherein there are 5–7 groups.

5. The board game apparatus of claim 4 wherein there are six groups.

6. The board game apparatus of claim 2 wherein said groups representing major alliances are each assigned a separate visual indicator.

7. The board game apparatus of claim 6 wherein said indicators are imprinted on said illustrations of said nations or regions on said map.

8. The board game apparatus of claim 1 wherein said spaces along said border path associated with said nations or regions illustrated on said map contain visual indicators corresponding to the indicators coding said spaces on said map.

9. The board game apparatus of claim 8 wherein said visual indicators are colors.

10. The board game apparatus of claim 1 wherein said spaces of chance along said border path are interspersed between said spaces associated with said nations or regions.

11. The board game apparatus of claim 10 wherein said spaces of chance along said border path are so designated by imprinting markings of various incident symbols and monetary awards on said game board within said spaces.

12. The board game apparatus of claim 1 wherein said spaces along said border path associated with said nations or regions contain markings indicating the names and the economic values of said nations or regions.

13. The board game apparatus of claim 1 wherein the cells within said network of cells overlaid over said map to subdivide said playing board are of uniform size and are arranged into coded horizontal rows.

14. The board game apparatus of claim 1 wherein said nations or regions illustrated on said map contain number markings indicating the size of said nations or regions as measured by number of individual cells constituting each said nation or region.

* * * * *